United States Patent [19]

Komamura et al.

[11] Patent Number: 4,987,049

[45] Date of Patent: Jan. 22, 1991

[54] IMAGE-RECEIVING ELEMENT FOR HEAT TRANSFER TYPE DYE IMAGE

[75] Inventors: Tawara Komamura; Nobuyuki Takiyama; Katsunori Katoh, all of Hino, Japan

[73] Assignee: Konica Corporation, Tokyo, Japan

[21] Appl. No.: 553,781

[22] Filed: Jul. 13, 1990

[30] Foreign Application Priority Data

Jul. 21, 1989 [JP] Japan ..... 64-189668
Sep. 19, 1989 [JP] Japan ..... 64-244539

[51] Int. Cl.[5] ..... G03C 5/54

[52] U.S. Cl. ..... 430/203; 430/213; 430/216; 430/222; 430/237

[58] Field of Search ..... 430/203, 213, 216, 222, 430/237, 226, 223, 551, 372

[56] References Cited

U.S. PATENT DOCUMENTS 4,239,847 12/1980 Archie et al. ..... 430/213
4,343,886 8/1982 Nakamura et al. ..... 430/237
4,581,314 4/1986 Reczek et al. ..... 430/213
4,871,647 10/1989 Komamura et al. ..... 430/203

*Primary Examiner*—Richard L. Schilling

*Attorney, Agent, or Firm*—Frishauf, Holtz, Goodman & Woodward

[57] ABSTRACT

An image-receiving element for heat transfer type dye image, which comprises a support, a binder and a compound represented by the formula (I) shown below on the support: Formula (I)

$$[M(X_1)_l(X_2)_m(X_3)_n]^{P+}Q$$

wherein, M represents a transition metal ion, $X_1$, $X_2$ and $X_3$ represent a coordination compound capable of forming a complex by coordinate bonding with the transition metal ion, Q is at least one of and $(R_5—SO_3^-)_p$, $R_1$, $R_2$, $R_3$ and $R_4$ each represent an alkyl group, an aryl group, a cyano group, a heterocyclic residual group or hydrogen atom (these may be the same or different), $R_5$ represents an alkyl group or an aryl group, p represents 1, 2 or 3, m represents 1, 2 or 0, n represents 1 or 0, and p represents 1 or 2.

18 Claims, No Drawings

IMAGE-RECEIVING ELEMENT FOR HEAT TRANSFER TYPE DYE IMAGE

BACKGROUND OF THE INVENTION

The present invention relates to an image-receiving element for heat transfer type dye image, more specifically to diffusion transfer type heat-developable light-sensitive material or an image-receiving element for heat transfer type dye image.

It has been known in the prior art to obtain color images by transferring dyes to image-receiving elements by heating For example, in the system known as diffusion transfer type heat developable light-sensitive material, color images can be obtained by transferring diffusible dyes, formed for image forming upon heat development, onto image-receiving elements in a heat development step and/or subsequent transfer step.

The above image forming method is described in, for example, Japanese Unexamined Pat. Publications Nos. 12431/1984, 159159/1984, 181345/1984, 229556/1984, 2950/1985, 52643/1986, 61158/1986, 61157/1986, 180550/1984, 132952/1986 and 139842/1986, U.S. Pat. Nos. 4,595,652, 4,590,154 and 4,584,267, etc.

In the system known as heat transfer system, color images can be obtained by heating heat transfer materials by a thermal head to transfer heat diffusible dyes onto image-receiving elements. By controlling thermal energy of the thermal head in this operation, gradation of images can be obtained.

The above image forming system is described in, for example, the specifications of Japanese Unexamined Pat. Publications Nos. 239289/1985, 22993/1986 and 63194/1989, etc.

In the above-mentioned methods, it is required that the dyes are thermally high diffusible in order to shorten the transferring time and facilitate reduction of thermal energy. However, if the dyes are designed to be high diffusible, image density will be lowered by retransfer of color images on the image-receiving elements thus obtained during storage, etc. thereby resulting in the defect of deterioration of fixing property.

As a technique for solving such a problem, the specifications of Japanese Unexamined Patent Publications Nos. 48765/1984 and 124337/1984 disclose the method in which fixing property can be improved by forming heat-diffusible dyes, which is capable of chelating, by heat development, transferring the dyes onto image-receiving elements and thereby forming chelated dye images in the image-receiving elements. The specifications of Japanese Unexamined Pat. Publications Nos. 78893/1984 and 2398/1985 disclose the method in which fixing property can be improved by heating light-sensitive transfer materials containing heat-diffusible or sublimatable, which is capable of chelating, dyes and thereby transferring the dyes to form chelated dye images in the image-receiving elements.

These methods are excellent in improvement in fixing property and stability of dyes to heat, light, etc. However, the image-receiving elements used for such systems includes the following problems.

More specifically, it is difficult to permit compounds, which supply metal ions to dyes (hereinafter, called as a metal source), to exist in image-receiving elements in a stably dispersed condition. Particularly, in the case of adding the metal source to hydrophobic binders, which are preferable binders when heat-diffusible dyes are received, uneven density of images and reduction of image quality of image-receiving elements were caused by precipitation and coagulation of the metal source. The method further include problems that a part of dyes remains in the unchelated state due to low rate of the chelating reaction, that white background portions are stained by coloring of the metal source, etc.

SUMMARY OF THE INVENTION

The present invention is accomplished for solving the above-mentioned defects in the prior art.

More specifically, a first object of the present invention is to provide an image-receiving element capable of forming images having good fixing property.

A second object of the present invention is to provide an image-receiving element which does not cause precipitation and coagulation of the metal source, uneven density of images and reduction of image quality.

A third object of the present invention is to provide an image-receiving element capable of facilitating chelating reaction of dyes, which is capable of chelating, in the image-receiving element.

A fourth object of the present invention is to provide an image-receiving element containing the metal source which is improved in the white background portion.

The present inventors have intensively studied and found that the objects of the present invention can be accomplished by an image-receiving element for heat transfer type dye image comprising a support, a binder and a compound represented by the formula (I) shown below on the support: Formula (I):

$$[M(X_1)_\lambda(X_2)_m(X_3)_n]^{p+}Q$$

wherein, M represents a transition metal ion, $X_1$, $X_2$ and $X_3$ represent a coordination compound capable of forming a complex by coordinate bonding with the transition metal ion, Q represents $$(R_1-\overset{\overset{R_2}{|}}{\underset{\underset{R_3}{|}}{B}}-R_4)_p^-$$

or $(R_5-SO_3-)p$, $R_1$, $R_2$, $R_3$ and $R_4$ each represent an alkyl group, an aryl group, a cyano group, a heterocyclic residual group or hydrogen atom (these may be the same or different), $R_5$ represents an alkyl group or an aryl group, $\lambda$ represents 1, 2 or 3, m represents 1, 2 or 0, n represents 1 or 0, and p represents 1 or 2.

DESCRIPTION OF THE PREFERRED EMBODIMENTS

In the formula (I), M represents a transitional metal ion, preferably divalent transitional metal ion such as cobalt (II), nickel (II), copper (II), zinc (II), iron (II), etc., particularly preferably nickel (II) and copper (II).

$X_1$, $X_2$ and $X_3$ represent a coordination compound capable of forming a complex by coordinate bonding with the transition metal ion, which may be the same or different. These coordination compounds are selected from the coordination compounds described in, for example, "Chelate Chemistry (5)" by Nankodo.

$\lambda$ represents 1, 2 or 3, m represents 1, 2 or 0, n represents 1 or 0. These are determined depending on whether the coordination number of the complex represented by the formula (I) is 4 or 6 and/or the number of ligands of $X_1$, $X_2$ and $X_3$.

p represents 1 or 2, preferably 2. When p is 2, ligand groups of the coordination compounds represented by $X_1$, $X_2$ and $X_3$ are not anionated.

$R_1$, $R_2$, $R_3$ and $R_4$ each represent an alkyl group, an aryl group, a cyano group, a heterocyclic residual group or hydrogen atom, preferably an alkyl group or aryl group having 4 to 12 carbon atoms, which may be substituted.

$R_1$, $R_2$, $R_3$ and $R_4$ are particularly, preferably a phenyl group or an alkyl-substituted phenyl group.

Specific examples of

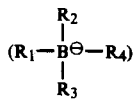

are shown below.

(1)

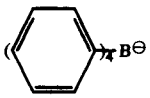

(2)

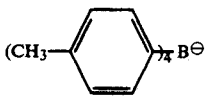

(3)

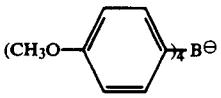

(4)

$(C_4H_9)_4B^{\ominus}$ (5)

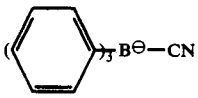

(6)

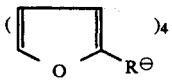

(7)

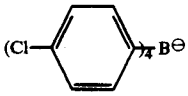

$R_5$ represents an alkyl group or an aryl group, which may further have a substituent, preferably an alkyl group or an aryl group having 8 or more carbon atoms, more preferably 12 or more carbon atoms, including also carbon atoms of the substituent, particularly, preferably a substituted phenyl group having 12 or more carbon atoms.

Specific examples of $R_5-SO_3^-$ are shown below.

$C_qH_{2q+1}SO_3^-$ (8)

(q is an integer of 8 to 24)

$C_qH_{2q+1}OCH_2CH_2SO_3^-$ (q−8~24) (9)

(10)

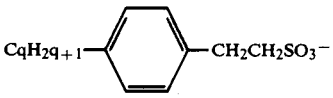

(q = 8 ~ 24)

(11)

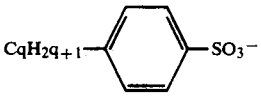

-continued (q = 8 ~ 24)

(12)

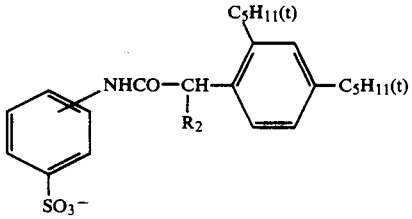

($R_2$ = H, $CH_3$, $C_2H_5$ or $-C_4H_9$)

(13)

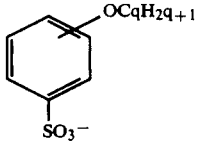

(q = 8 to 24)

(14)

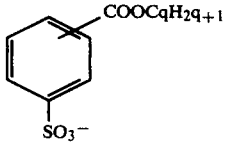

(q = 8 to 24)

$C_qH_{2q-1}-CH_2CH_2SO_3^-$ (15)

(q = 8 ~ 24)

(16)

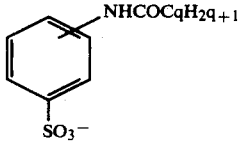

(q = 8 ~ 24)

(17)

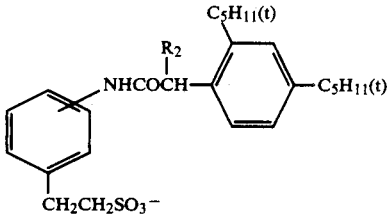

($R_2$ = H, $CH_3$, $C_2H_5$ or $-C_4H_9$)

Benzene rings substituted with a $SO_3^-$ group or a $CH_2CH_2-SO_3^-$ group may further have a substitutent or substitutents.

Specific examples of the ligands represented by $K_1$, $K_2$ and $X_3$ are shown below.

(1) $NH_3$ (2) $NH_2CH_2(NHCH_2CH_2)nNH_2$ (n=0 or 1)

(3) $NH_2(CH_2)nNH_2$ (n=2 or 3)

(4) $C_2H_5NHCH_2CH_2NHC_2H_5$ (5)

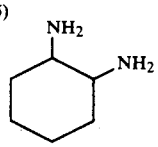

(6)

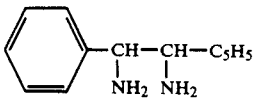

-continued
(7)
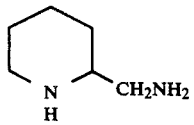
(8)
$C_2H_5NCH_2CH_2NH_2$
(9)
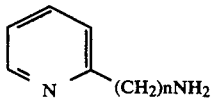
(n = 1 or 2)
(10)
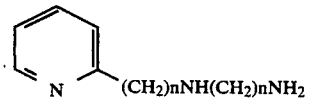
(n = 1 or 2)
(11)
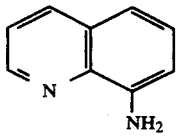
(12)
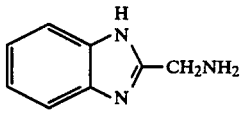
(13)
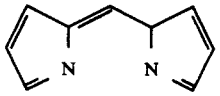
(14)
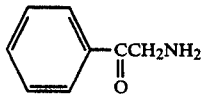
(15)
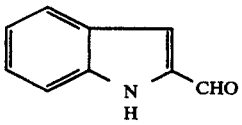
(16)
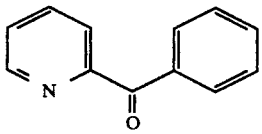
(17)
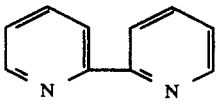
(18)
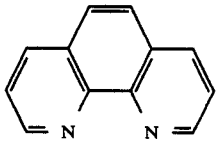
-continued
(19)
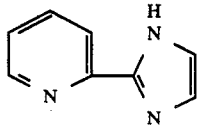
(20)
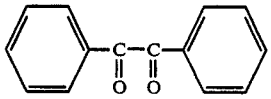
(21)
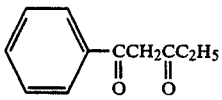
(22)
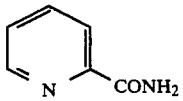
(23)
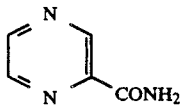
(24)
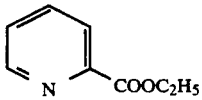
Specific examples of the compounds represented by the formula (I) are shown below. X−1 to X−24 are the compounds in the case where Q is
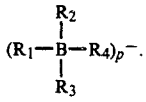
X−1 $[Cu(NH_2CH_2CH_2NH_2)_2]^{2+}[(C_6H_5)_4B]^-{}_2$
X−2 $[Ni(NH_2CH_2CH_2NH_2)_3]^{2+}[(C_6H_5)_4B]^-{}_2$
X−3 $[Co(NH_2CH_2CH_2NH_2)_3]^{2+}[(C_6H_5)_4B]^-{}_2$
X−4 $[Zn(NH_2CH_2CH_2NH_2)_3]^{2+}[(C_6H_5)_4B]^-{}_2$
X−5 $[Ni(C_2H_5NHCH_2CH_2NH_2)_3]^{2+}[(C_6H_5)_4B]^-{}_2$
X−6 $[Ni(C_2H_5NHCH_2CH_2NHC_2H_5)_3]^{2+}[(C_6H_5)_4B]^-{}_2$
X−7 $[Ni(NH_2CH_2CH_2NHCH_2CH_2NH_2)_2]^{2+}[(C_6H_5)_4B]^-{}_2$
X-8
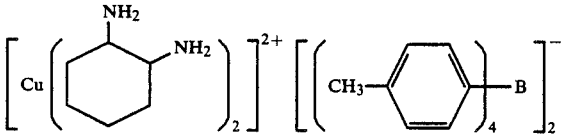
X-9
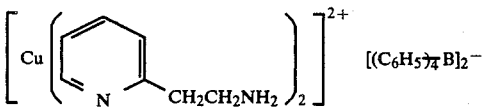
X-10
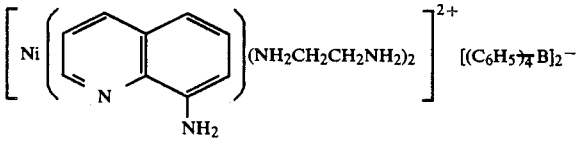
X-11
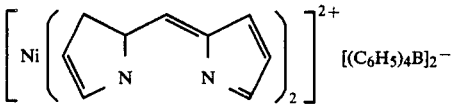

-continued
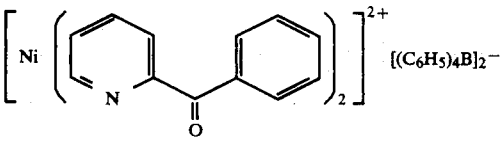
$[(C_6H_5)_4B]_2^-$ X-12
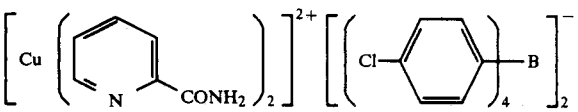
X-13
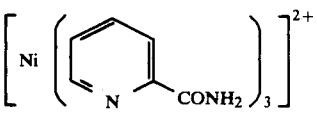
$[(C_6H_5)_4B]_2^-$ X-14
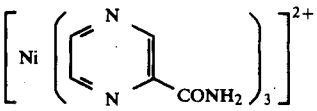
$[(C_6H_5)_4B]_2^-$ X-15
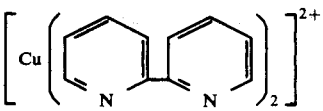
$[(C_6H_5)_4B]_2^-$ X-16
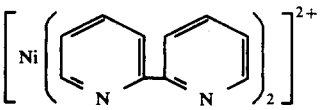
$[(C_6H_5)_3BCN]_2^-$ X-17
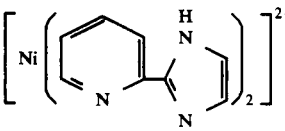
$[(C_6H_5)_4B]_2^-$ X-18
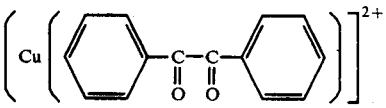
$[(C_6H_5)_4B]_2^-$ X-19
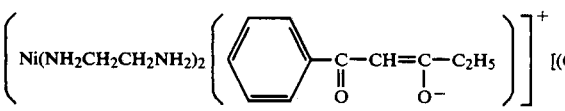
$[(C_6H_5)_4B]^-$ X-20
$[Ni(NH_2CH_2CH_2CH_2NH_2)_3]^{2+}[(n\text{-}C_4H_9)_4B]_2^-$ X-21
$[Ni(C_2H_5NHCH_2CH_2NH_2)_2(NH_2CH_2CH_2NH_2)]^{2+}[(C_6H_5)_4B]_2^-$ X-22
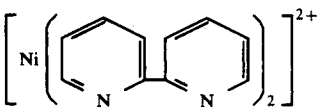
$[(C_6H_5)_4B]_2^-$ X-23
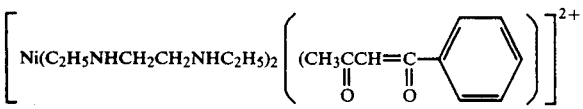
$[(C_6H_5)_4B]_2^-$ X-24
X−25 to X−46 are examples in the case where Q is $(R_5-SO_3-)p$.

| Compound No. | M | $X_1$ | $X_2$ | $X_3$ | l | m | n | P | $R_5$ |
|---|---|---|---|---|---|---|---|---|---|
| X-25 | Ni | $NH_2CH_2CH_2NH_2$ | — | — | 3 | 0 | 0 | 2 | $C_{14}H_{29}SO_3^-$ |
| X-26 | Ni | $NH_2CH_2CH_2NH_2$ | — | — | 3 | 0 | 0 | 2 | 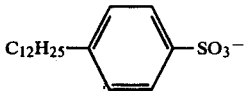 |
| X-27 | Cu | $NH_2CH_2CH_2NH_2$ | — | — | 2 | 0 | 0 | 2 | 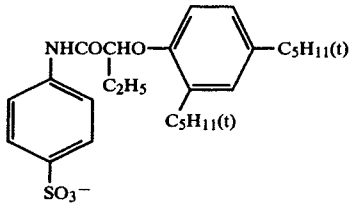 |
| X-28 | Ni | 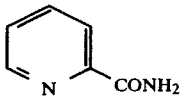 | — | — | 3 | 0 | 0 | 2 | 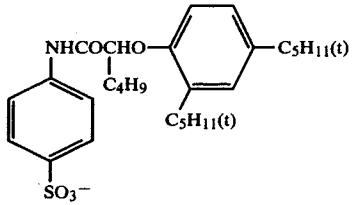 |
| X-29 | Cu | 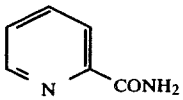 | — | — | 2 | 0 | 0 | 2 | 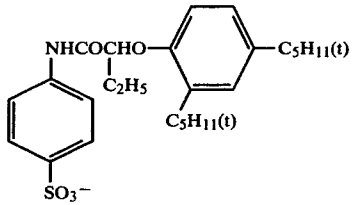 |
| X-30 | Zn | 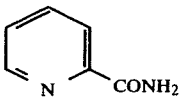 | — | — | 3 | 0 | 0 | 2 | 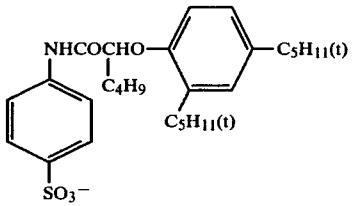 |

-continued
| Compound No. | M | $X_1$ | $X_2$ | $X_3$ | l | m | n | P | $R_5$ |
|---|---|---|---|---|---|---|---|---|---|
| X-31 | Co | 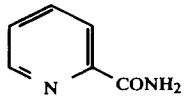 | — | — | 3 | 0 | 0 | 2 | 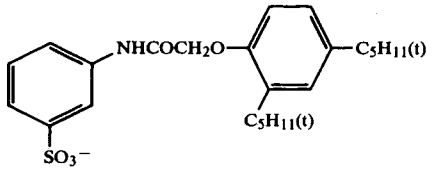 |
| X-32 | Ni | $C_2H_5NHCH_2CH_2NH_2$ | — | — | 3 | 0 | 0 | 2 | 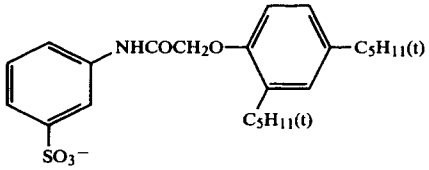 |
| X-33 | Ni | $NH_2CH_2CH_2NH_2$ | 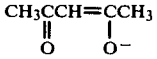 | — | 2 | 1 | 0 | 1 | 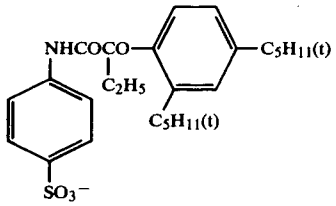 |
| X-34 | Ni | 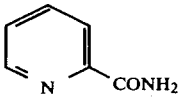 | $NH_2CH_2CH_2NH_2$ | 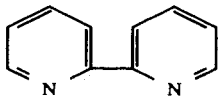 | 1 | 1 | 1 | 2 | $C_{12}H_{23}CH_2CH_2SO_3^-$ |
| X-35 | Cu | $C_2H_5NHCH_2CH_2NHC_2H_5$ | — | — | 2 | 0 | 0 | 2 | $C_{12}H_{23}CH_2CH_2SO_3^-$ |
| X-36 | Ni | $NH_2CH_2CH_2NHCH_2CH_2NH_2$ | — | — | 2 | 0 | 0 | 2 | 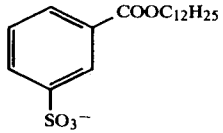 |

-continued
| Compound No. | M | $X_1$ | $X_2$ | $X_3$ | l | m | n | P | $R_5$ |
|---|---|---|---|---|---|---|---|---|---|
| X-37 | Ni | 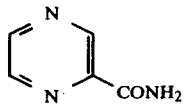 | — | — | 3 | 0 | 0 | 2 | 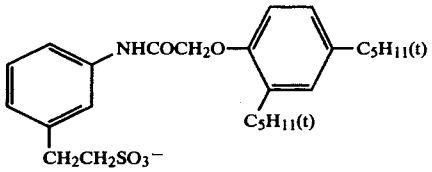 |
| X-38 | Ni | 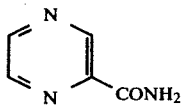 | 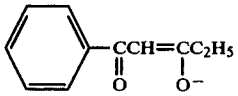 | — | 2 | 1 | 0 | 1 | 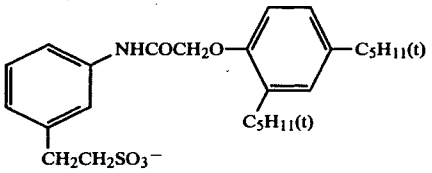 |
| X-39 | Ni | 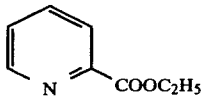 | — | — | 3 | 0 | 0 | 1 | $C_{14}H_{29}OCH_2CH_2SO_3^-$ |
| X-40 | Cu | 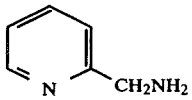 | $NH_2CH_2CH_2NH_2$ | — | 1 | 1 | 0 | 2 | $C_{12}H_{25}OCH_2CH_2SO_3^-$ |
| X-41 | Ni | 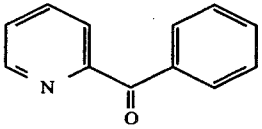 | — | — | 2 | 0 | 0 | 2 | 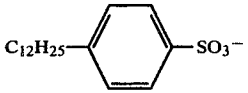 |
| X-42 | Ni | 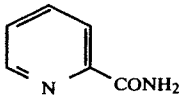 | — | — | 3 | 0 | 0 | 2 | 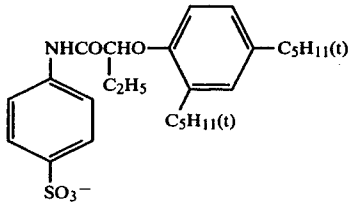 |

-continued
| Compound No. | M | $X_1$ | $X_2$ | $X_3$ | l | m | n | P | $R_5$ |
|---|---|---|---|---|---|---|---|---|---|
| X-43 | Cu | 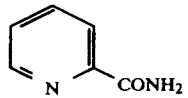 | — | — | 2 | 0 | 0 | 2 | 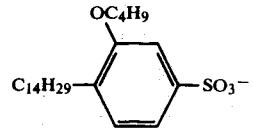 |
| X-44 | Ni | 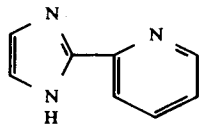 | 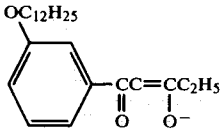 | — | 2 | 1 | 0 | 1 | 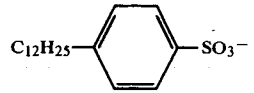 |
| X-45 | Ni | 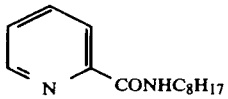 | — | — | 2 | 0 | 0 | 2 | $C_{12}H_{25}SO_3^-$ |
| X-46 | Cu | 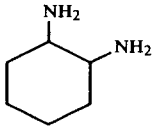 | — | — | 2 | 0 | 0 | 2 | 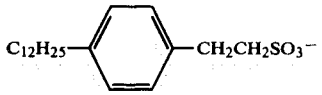 |

The compound represented by the formula (I) of the present invention can be synthesized as described below.

In the instance where Q is

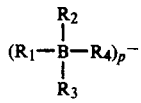

at first, inorganic salts such as hydrochlorides, sulfates, nitrates, etc. of the ligand represented by X and the transitional metal represented by M are reacted in the system comprising of water as a main solvent to form a water-soluble complex.

Subsequently, an aqueous solution of

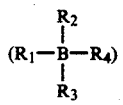

Na is added thereto and the settled solids are filtered off to synthesize the compound represented by the formula (I).

In the instance where Q is $(R_5-SO_3^-)_p$, the compounds represented by the formula (I) can be synthesized as described below.

At first, inorganic salts such as hydrochlorides, sulfates, nitrates, etc. of the ligand represented by X and the transitional metal represented by M are reacted in the system comprising of water as a main solvent to form a water-soluble complex.

Subsequently, an aqueous solution of a salt of $R_1SO_3^-$ (for example, Na salt or K salt) is added thereto and the settled solid is filtered off, or extracted with water-inmiscible organic solvent such as ethyl acetate, ethyl ether, etc., followed by concentration to dryness. The thus obtained solid is purified by using alcohol or the like, if necessary.

The method for adding the compound represented by the formula (I) of the present invention to the image-receiving element for heat transfer type dye images is optionally selected, but generally be the method in which a coating liquid containing the compound of the formula (I) is prepared by dissolving the compound into a solvent with a binder polymer mentioned below, or dispersing the compound, alone or in the state of being dissolved in a suitable solvent, into a solvent in which the binder polymer is previously dissolved, in the fine particle state, followed by coating and drying on a support.

The amount of the compound represented by the formula (I) used is not limitative, but varies depending on the kind of the compound and conditions in use, and ordinarily in the range of 0.05 to 10 g, preferably 0.2 to 3.0 g per 1 $m^2$ of the support.

The binder of the present invention may be either hydrophilic polymers such as gelatin, polyvinyl butyral, polyvinyl alcohol, ethylcellulose, etc. or hydrophobic polymers, but preferably hydrophobic polymers, particularly heat-resistant hydrophobic polymers having a glass transition temperature of 40° to 250° C.

The hydrophobic polymers may include polystyrene, polyvinyl butyral, polyvinyl chloride, polyesters such as polyethylene terephthalate, polycarbonates such as bisphenol A polycarbonate, polyacrylates such as poly n-butylacrylate, and the like.

A blend polymer using two or more of these polymers in combination may be used. Further, a copolymer thereof with, for example, vinyl chloride and acrylate may be used.

Particularly preferable polymers are polyvinyl chloride described in Japanese Unexamined Pat. Publication No. 223425/1984 and polycarbonate containing a plasticizer described in Japanese Unexamined Pat. Publication No. 19138/1985.

These polymers may be used for preparation of a support which also serves as an image-receiving element. In this instance, the support may be composed of a single layer, or a large number of layers.

The binder of the present invention may further contain various additives. Preferred as the additives are ultra violet ray absorbents, anti-fading additives, etc. described in Japanese Unexamined Patent Publications Nos. 158289/1984, 182785/1984, 130735/1985, 118748/1986, 153638/1986, 159644/1986, etc.

As another additives, there may be included various matting agents, colloidal silica, sliding agents, organic fluoro compounds particularly fluorine type surfactants, antistatic agents, high-boiling temperature organic solvent, plasticizers, polymer latex, etc.

In the instance where the image-receiving element of the present invention is used with the diffusion transfer type heat-developable light-sensitive material, anti-stain agents described in Japanese Unexamined Pat. Publications Nos. 118155/1988, Japanese patent application Ser. No. 19340/1988, 111994/1988, 113972/1988, etc., development accelerators as described in Japanese patent application Ser. No. 283882/1987, etc. may be added.

As a support of the present invention, both of transparent support and opaque support may be used, and there may be used, for example, films of polyethylene terephthalate, polycarbonate, polystyrene, polyvinyl chloride, polyethylene, polypropylene, etc., or supports containing pigments such as titanium oxide, barium sulfide, calcium carbonate, talc, etc. in the above film; baryta paper, RC papers laminated with thermosetting resin containing pigments on a paper, clothes, glass, metals such as aluminum, etc.; supports coated with electron curable resin composition containing pigments to be cured on these supports; supports provided with a coating layer containing pigments on these supports, and the like. Further, a cast coated paper described in Japanese Unexamined Pat. Publication No. 283333/1987 is also useful as a support.

The present invention will be illustrated with reference to examples hereinbelow, but is not limitative to the following examples.

EXAMPLE 1

(Preparation of image-receiving element)

Image-receiving element-1 was prepared by using a synthetic paper of 150 μm in thickness (YUPO-FRG 150, produced by Ooji Yuka Co.) and coating a coating liquid having the composition shown below thereon until the coated amount of polyvinyl chloride became 6 g/$m^2$. No coloring of the image-receiving element was occurred.

| | |
|---|---|
| Polyvinyl chloride | 70 g |
| Compound of the present invention (X-2) | 1.5 g |

-continued

| | |
|---|---|
| Tetrahydrofuran | 100 mg |

Image-receiving elements-2 to 20 were further prepared in the same manner as in Image-receiving element-1 provided that the compound of the present invention or comparative compound shown in Table 1 was used instead of the compound of the present invention (X-2) or no compound of the present invention was added.

(Preparation of heat transfer sheet)

A mixture comprised of the composition shown below was treated by using a paint conditioner to obtain ink of uniform solution containing a yellow, heat transfer type dye.

| | |
|---|---|
| Yellow dye shown below | 15 g |
| Polyvinyl butyral resin | 20 g |
| Methyl ethyl ketone | 150 ml |
| Toluene | 150 ml |

Ink containing magenta or cyan dye shown below were likewise obtained.

Yellow dye

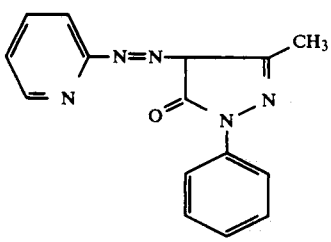

Magenta dye (used for preparation of Image-receiving elements 1 to 10):

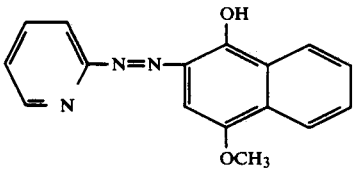

Magenta dye (used for preparation of Image-receiving elements 11 to 20):

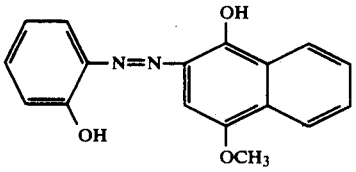

Cyan dye

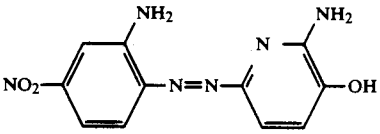

Three kinds of heat transfer materials each containing yellow, magenta or cyan dye were prepared by coating the above ink on a support 1 comprised of polyimide film of 15 μm in thickness in such a manner that the coating amount after drying may become 1.0 g/m², followed by drying.

The thus obtained heat transfer material and image-receiving elements are laminated in such a manner that the surface coated with the ink and the image-receiving face may face each other, and subjected to recording by using a thermal head to obtain transferred images comprised of yellow, magenta or cyan on each of Image-receiving elements-1 to 20.

Reflectance densities of the images thus obtained were measured and shown in Table 1.

The recording conditions are as shown below.

| | |
|---|---|
| secondary scanning | 4 dots/mm |
| Electricity for recording | 0.6 w/dot |
| Heating time of head | 10 m · sec |

TABLE 1

| Image-receiving element No. | Added compound | Added amount (g/m²) | Density Yellow | Magenta | Cyan | Remarks |
|---|---|---|---|---|---|---|
| 1 | X-2 | 0.9 | 1.54 | 2.04 | 1.84 | Inv. |
| 2 | X-2 | 0.5 | 1.52 | 2.01 | 1.82 | Inv. |
| 3 | X-5 | 0.8 | 1.53 | 2.02 | 1.83 | Inv. |
| 4 | X-1 | 0.6 | 1.51 | 2.07 | 1.84 | Inv. |
| 5 | X-14 | 0.9 | 1.52 | 2.03 | 1.81 | Inv. |
| 6 | X-15 | 0.9 | 1.51 | 2.01 | 1.82 | Inv. |
| 7 | X-19 | 0.9 | 1.53 | 2.02 | 1.81 | Inv. |
| 8 | Comp. (A) | 0.8 | 1.29 | 1.72 | 1.59 | Cont. |
| 9 | Comp. (B) | 0.7 | 1.22 | 1.69 | 1.54 | Cont. |
| 10 | — | — | 0.85 | 1.51 | 1.40 | Cont. |
| 11 | X-26 | 0.8 | 1.52 | 2.01 | 1.82 | Inv. |
| 12 | X-28 | 1.0 | 1.50 | 1.08 | 1.80 | Inv. |
| 13 | X-29 | 1.0 | 1.51 | 2.00 | 1.84 | Inv. |
| 14 | X-35 | 0.9 | 1.51 | 2.03 | 1.82 | Inv. |
| 15 | X-37 | 1.0 | 1.52 | 2.02 | 1.83 | Inv. |
| 16 | X-42 | 0.8 | 1.53 | 2.01 | 1.82 | Inv. |
| 17 | X-42 | 1.2 | 1.55 | 2.03 | 1.80 | Inv. |
| 18 | Comp. (A) | 0.8 | 1.29 | 1.72 | 1.59 | Cont. |
| 19 | Comp. (B) | 0.7 | 1.22 | 1.69 | 1.54 | Cont. |
| 20 | — | — | 0.85 | 1.51 | 1.40 | Cont. |

Note: Inv. is This invention, Cont. is control.
Compound (A)
Nickel stearic phosphate
Compound (B)

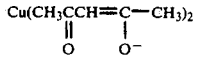

As shown in Table 1, the image-receiving elements using the compound of the present invention can provide transferred images with high density, while Image-receiving elements 8, 9, 18 and 19 are lower in transferred density as compared with those of the present invention. It is estimated that the chelating reaction of dyes of the controls are slower than that of the image-receiving elements of the present invention and thereby complete chelating of dyes is not conducted when transfer is carried out. Further, in the case of Image-receiving elements-10 and -20 with no addition of the metal source, further lowering of the density was recognized.

In image-receiving elements-8, 9, 18 and 19, harshness on the surface and unevenness of transfer density, which are estimated to be caused by settlement of the metal source, were recognized, while no such defect was recognized in Image-receiving elements- 8, 9, 18 and 19 were bluish, and the white background was deteriorated.

EXAMPLE 2

The image-receiving surfaces of the transferred images on Image-receiving elements- 1 to 10 and 11 to 20 obtained in Example 1 were brought into close contact with the image-receiving surfaces of Image-receiving elements 1 to 20 in Example 1, respectively, and left for 1 week. In the image-receiving elements- 10 or 20, the transferred images were retransferred onto the image-receiving elements-8, 9, 10, 18, 19 and 20, resulting in lowering of image density and bleeding of images. These phenomena were particularly remarkable in the contact between Image-receiving elements-10 and 10 and that between 20 and 20, but was hardly recognized in Image-receiving elements of the present invention.

Image-receiving elements 1 to 20 were irradiated with use of a xenon fademeter for 48 hours after transfer. In Image-receiving elements-1 to 7 and 11 to 17 of the present invention, only 5% or less of lowering of the density was recognized in each yellow, magenta and cyan images, while 10 to 15% in Image-receiving elements-8, 9, 18 and 19, and 30 to 40% in Image-receiving elements-10 and 20.

From the above, it is apparent that the use of Image-receiving elements of the present invention can attain excellent fixing property and light fastness.

EXAMPLE 3

Image-receiving elements-21 and 22 were prepared in the same manner as of Image-receiving element-1 in Example 1 provided that the polymer binder used for Image-receiving element-1 was replaced with polycarbonate (Panlite, produced by Teijin Co.; contains 10% of a plasticizer, dibutylphthalate) or polyester (Byronal MD-1200, produced by Toyobo K.K.). Similarly, Image-receiving elements-23 and 24 were prepared as in Image-receiving element-12 in Example 1.

By using Image-receiving elements-21 to 24 thus obtained, image recording was conducted in the similar method as in Example 1.

As shown in Table 2, the images obtained were color images of high density. These color images thus obtained were evaluated in Fixing property and light fastness in the same manner as in Example 2, but only 5% or less of lowering of the density were recognized in both values.

TABLE 2

| Image-receiving element | Polymer binder | Yellow | Magenta | Cyan |
|---|---|---|---|---|
| 21 | Polycarbonate | 1.49 | 1.93 | 1.79 |
| 22 | Polyester | 1.39 | 1.85 | 1.70 |
| 23 | Polycarbonate | 1.51 | 1.99 | 1.83 |
| 24 | Polyester | 1.43 | 1.88 | 1.75 |

EXAMPLE 4

Preparation of heat-developable light-sensitive material

On a transparent polyethylene terephthalate film having a thickness of 180 μm and being applied with a latex subbing layer, a light-sensitive layer was prepared by coating a composition shown below (the coated amount was per 1 $m^2$ of a support) to prepare Heat-developable light-sensitive material-1.

| | |
|---|---|
| Magenta dye-providing material shown below | 0.9 g |
| Silver benztriazole | 1.0 g |
| Red-sensitive silver halide (silver iodobromide of regular octahedron shape containing 7 mole % of silver iodide and having the average grain size of 0.3 μm) | 0.4 g |
| Gelatin | 3.0 g |
| Polyvinyl pyrrolidone | 0.2 g |
| Heat solvent shown below | 4.5 g |
| Inhibitor shown below | 0.7 mg |
| Tricresyl phosphate | 0.9 g |
| Scavenger shown below | 0.08 g |
| Reducing agent shown below (precurser) | 0.6 g |

Dye-providing material-1 (magenta dye-providing material)

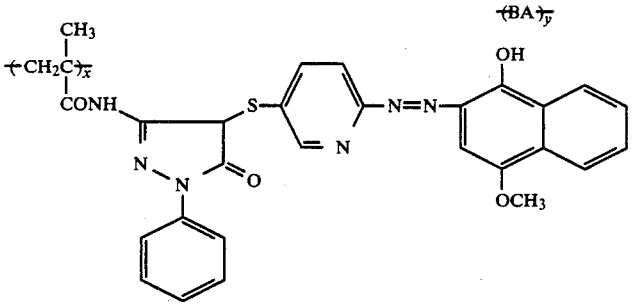

x: 50 wt % y: 50 wt %

(BA = n-butylacrylate, hereinafter the same)

Heat-solvent

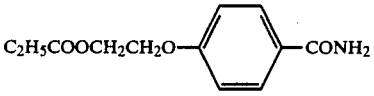

Inhibitor

-continued

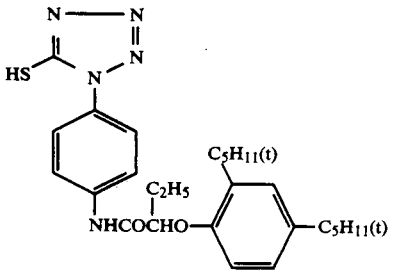

Scavenger

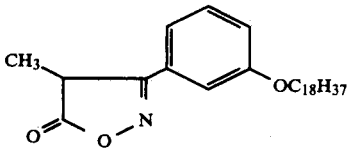

Reducing agent

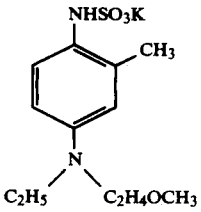

Next, Heat-developable light-sensitive materials-2, 3 and 4 were prepared in the same manner as in the preparation of Heat-developable light-sensitive material-1 provided that the dye-providing material was changed with Dye-providing materials 2, 3 and 4 shown below, respectively.

Dye-providing material-2

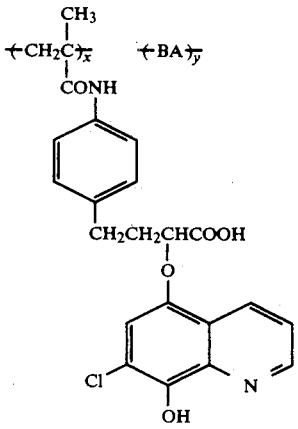

x: 60 wt % y: 40 wt %

Coated amount: 0.65 g/m$^2$

Dye-providing material-3 (cyan dye-providing material)

-continued

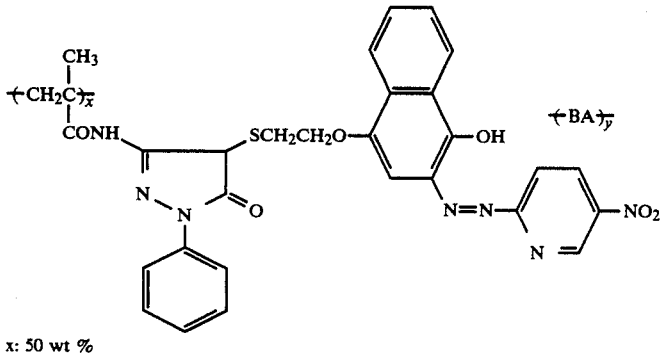

x: 50 wt %
y: 50 wt %
Coated amount: 0.9 g/m$^2$

Dye-providing material-4

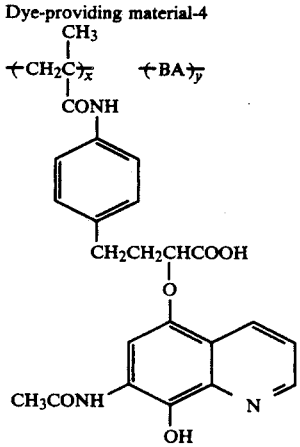

x: 60 wt %
y: 40 wt %
Coating amount: 0.65 g/m$^2$

Preparation of Image-receiving elements-101 to 108

On a baryta paper for photography, polyvinyl chloride containing the following compound was coated for forming an image-receiving layer to prepare Image-receiving element-101.

Coated amount of the polyvinyl chloride was 10 g per 1 m$^2$ of the support.

| | |
|---|---|
| Compound of the present invention X-2 | 0.6 g/m$^2$ |
| 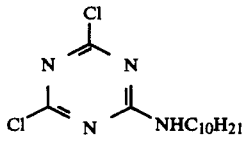 | 0.8 g/m$^2$ |
| $HO(CH_2)S(CH_2)_2S(CH_2)_2OH$ | 0.2 g/m$^2$ |

Heat-developable light-sensitive materials-1 and 2 thus obtained were subjected to red-light exposure of 800 CMS through a stepwedge, and laminated with Image-receiving elements-101, respectively, followed by heat development at 150° C. for 70 seconds. It was found that magenta reflection images with 1.92 in maximum density (Dmax) and 0.27 in fogging (Dmin) was obtained in the case of Heat-developable light-sensitive material-1, while infrared reflection images (λmax: 790 nm, maximum and minimum densities were reflection densities measured by using light of about 800 nm) with 2.09 in maximum density and 0.12 in fogging was obtained in the case of Heat-developable light-sensitive material-2.

Further, image-receiving elements-102 to 108 were prepared in the same manner as in the preparation of Image-receiving element-101 provided that the compound X-2 of the present invention used in Image-receiving element-101 was changed with the compounds shown in Table 3.

TABLE 3

| Image-receiving element No. | Compound | Added amount (g/m$^2$) | Remarks |
|---|---|---|---|
| 101 | X-2 | 0.6 | Invention |
| 102 | X-5 | 0.7 | Invention |
| 103 | X-11 | 0.7 | Invention |
| 104 | X-13 | 0.7 | Invention |
| 105 | X-14 | 0.7 | Invention |
| 106 | Compound (A) | 0.8 | Control |
| 107 | Compound (B) | 0.7 | Control |
| 108 | None | — | Control |

When the same heat development by exposure as in the above was conducted by using Heat-developable light-sensitive materials-1 and 2 and Image-receiving materials-102 to 108, Image-receiving elements-102 to 105 were imparted approximately the same images as in the case of using Image-receiving element-101, while Image-receiving elements-106 and 107, images with lowered maximum density as compared with Image-receiving element-101 and remarkable unevenness in transfer.

In the case of using Image-receiving element-108, Heat-developable light-sensitive material-1 received lowered density as compared with Image-receiving element-10, while Heat-developable light-sensitive material-2, no infrared image was obtained.

Preparation of Image-receiving elements-109 to 117

On a baryta paper for photography, polyvinyl chloride containing the following compound was coated for forming an image-receiving layer to prepare Image-receiving element-109.

The coated amount of the polyvinyl chloride was 10 g per 1 $m^2$ of the support.

| | |
|---|---|
| Compound of the present invention X-26 | 0.6 g/$m^2$ |
| 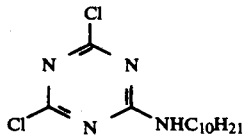 | 0.8 g/$m^2$ |
| $HO(CH_2)S(CH_2)_2S(CH_2)_2OH$ | 0.2 g/$m^2$ |

The thus obtained Heat-developable light-sensitive materials-3 and 4 were subjected to red-light exposure of 800 CMS through a stepwedge, and laminated with Image-receiving elements-109, respectively, followed by heat development at 150 ° C for 70 seconds. It was found that cyan reflection images with 1.76 in maximum density (Dmax) and 0.24 in fogging (Dmin) was obtained in the case of Heat-developable light-sensitive material-3, while infrared ray reflection images (λmax: 820 nm, maximum and minimum densities were reflection densities measured by using light of about 800 nm) of 2.10 in maximum density and 0.13 in fogging was obtained in the case of Heat-developable light-sensitive material-4.

Further, Image-receiving elements-110 to 117 were prepared in the same manner as in the preparation of the image-receiving element-109 provided that the compound X-26 of the present invention used in Image-receiving element-109 was changed with the compounds shown in Table 4.

TABLE 4

| Image-receiving element No. | Compound | Added amount (g/$m^2$) | Remarks |
|---|---|---|---|
| 109 | X-26 | 0.6 | Invention |
| 110 | X-5 | 0.7 | Invention |
| 111 | X-7 | 0.7 | Invention |
| 112 | X-12 | 0.7 | Invention |
| 113 | X-17 | 0.7 | Invention |
| 114 | X-18 | 0.7 | Invention |
| 115 | Compound (A) | 0.8 | Control |
| 116 | Compound (B) | 0.7 | Control |
| 117 | None | — | Control |

When the same heat development by exposure as in the above was conducted by using Heat-developable light-sensitive materials-3 and 4 and Image-receiving materials-110 to 117, Image-receiving elements-110 to 114 were imparted approximately the same images as in the case of Image-receiving element-109 for Heat-developable light-sensitive materials 3 and 4, while Image-receiving elements-115 and 116, images with lowered maximum density as compared with Image-receiving element-109 and remarkable unevenness in transfer.

In the case of using Image-receiving element-117, Heat-developable light-sensitive material-1 received lowered density as compared with Image-receiving element-20, while Heat-developable light-sensitive material-4, no infrared ray image was obtained.

EXAMPLE 5

Storage stability test

The images obtained in Example 4 were subjected to the tests of fixing property and light fastness similarly as in the case of Example 2.

In the samples using Image-receiving elements-101 to 105 and 109 to 114, deterioration of images was hardly recognized in both tests. In the samples using Image-receiving elements-106 to 108 and 115 to 117, deterioration of images such as lowered density and bleeding of images due to retransfer, or lowering of image density due to light irradiation, etc. were recognized. Such deterioration was particularly considerable in Image-receiving elements-108 and 116.

The use of the image-receiving elements of the present invention could provide images having higher density without unevenness, being excellent in light fastness in the high fixing state, and improved white background as compared with the image forming materials utilizing heat diffusion of dyes such as heat transfer materials, heat-developable light-sensitive materials, etc.

We claim:

1. An image-receiving element for heat transfer type dye image, which comprises a support, a binder and a compound represented by the formula (I) shown below on the support: Formula (I):

$$[M(X_1)_\lambda(X_2)m(X_3)n]^{p+}Q$$

wherein, M represents a transition metal ion, $X_1$, $X_2$ and $X_3$ represent a coordination compound capable of forming a complex by coordinate bonding with the transition metal ion Q represents

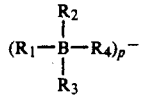

or $(R_5—SO_3^-)_d$, $R_1$,$R_2$, $R_3$ and $R_4$ each represent an alkyl group, an aryl group, a cyano group, a heterocyclic residual group or hydrogen atom (these may be the same or different), $R_5$ represents an alkyl group or an aryl group, λ represents 1, 2 or 3, m represents 1, 2 or 0, n represents 1 or 0, and p represents 1 or 2.

2. The image-receiving element for heat transfer type dye image according to claim 1, wherein M represents a divalent transitional metal ion.

3. The image-receiving element for heat transfer type dye image according to claim 1, wherein M represents at least one selected from the group consisting of cobalt (II), nickel (II), copper (II), zinc (II) and iron (II).

4. The image-receiving element for heat transfer type dye image according to claim 1, wherein $R_1$, $R_2$, $R_3$ and $R_4$ is at least one of an alkyl group and aryl group having 4 to 12 carbon atoms.

5. The image-receiving element for heat transfer type dye image according to claim 1, wherein $R_1$, $R_2$, $R_3$ and $R_4$ is at least one of a phenyl group and an alkyl-substituted phenyl group.

6. The image-receiving element for heat transfer type dye image according to claim 1, wherein Q is

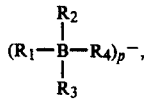

Q is at least one selected from the group consisting of (1) (2)

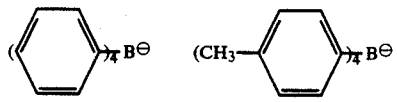

(3) (4)

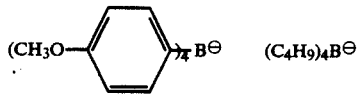

(5) (6)

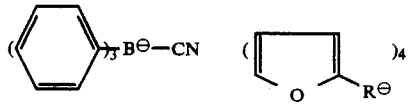

(7)

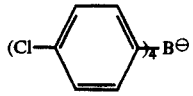

7. The image-receiving element for heat transfer type dye image according to claim 1, wherein Q is $(R_5-SO_3^-)_p$, Q is at least one selected from the group consisting of $C_qH_{2q+1}SO_3^-$ (8)

(q is an integer of 8 to 24)

$C_qH_{2q+1}OCH_2CH_2SO_3^-$ (q−8∼24) (9)

(10)

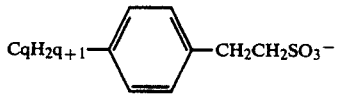

(q = 8 ~ 24)

(11)

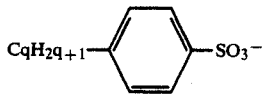

(q = 8 ~ 24)

(12)

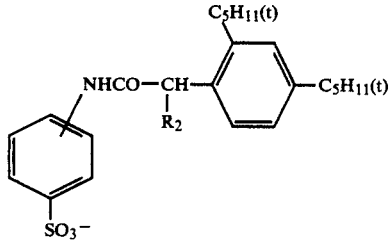

-continued ($R_2$ = H,$CH_3$,$C_2H_5$ or $-C_4H_9$)

(13)

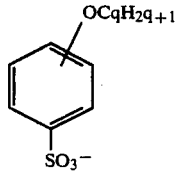

(q = 8 to 24)

(14)

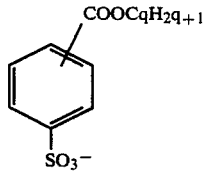

(q = 8 to 24)

$C_qH_{2q+1}-CH_2CH_2SO_3^-$ (15)
(q = 8 ~ 24)

(16)

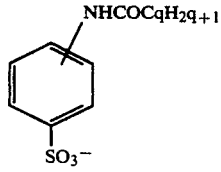

(q = 8 ~ 24)

(17)

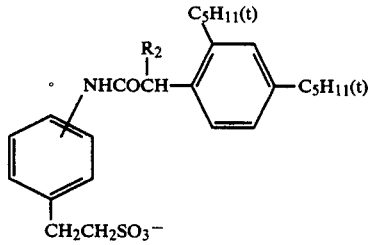

($R_2$ = H,$CH_3$,$C_2H_5$ or $-C_4H_9$).

8. The image-receiving element for heat transfer type dye image according to claim 1, wherein $R_5$ represents at least one of an alkyl group and an aryl group.

9. The image-receiving element for heat transfer type dye image according to claim 1, wherein $R_5$ represents at least one of an alkyl group and an aryl group having 8 or more carbon atoms.

10. The image-receiving element for heat transfer type dye image according to claim 1, wherein $R_5$ represents at least one of an alkyl group and an aryl group having 12 or more carbon atoms.

11. The image-receiving element for heat transfer type dye image according to claim 1, wherein $R_5$ represents a substituted phenyl group having 12 or more carbon atoms.

12. The image-receiving element for heat transfer type dye image according to claim 1, wherein the ligand represented by $X_1$, $X_2$ or $X_3$ is at least one selected from the group consisting of (1) $NH_3$
(2) $NH_2CH_2(NHCH_2CH_2)nNH_2$ (n=0 or 1)
(3) $NH_2(CH_2)nNH_2$ (n=2 or 3)
(4) $C_2H_5NHCH_2CH_2NHC_2H_5$ (5)

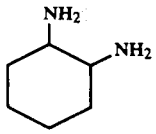

(6)

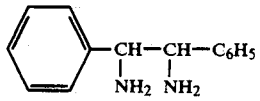

(7)

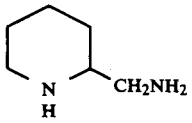

$C_2H_5NCH_2CH_2NH_2$ (8)

(9)

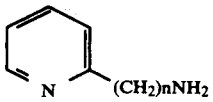

(n = 1 or 2)

(10)

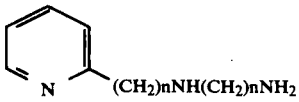

(n = 1 or 2)

(11)

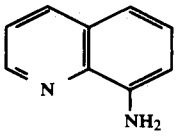

(12)

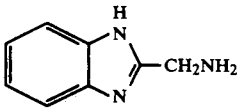

(13)

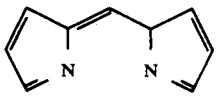

(14)

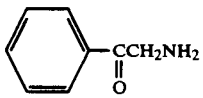

(15)

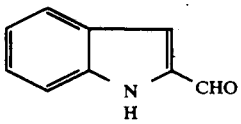

(16)

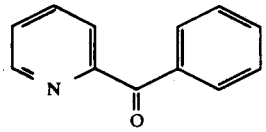

-continued (17)

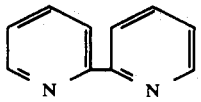

(18)

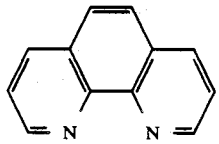

(19)

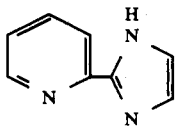

(20)

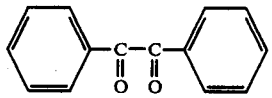

(21)

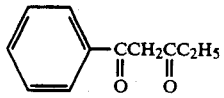

(22)

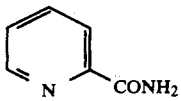

(23)

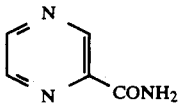

(24)

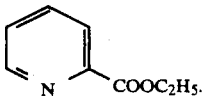

13. The image-receiving element for heat transfer type dye image according to claim 1, wherein the amount of the compound represented by Formula (I) is in the range of 0.05 to 10 g per 1 $m^2$ of the support.

14. The image-receiving element for heat transfer type dye image according to claim 1, wherein the amount of the compound represented by Formula (I) is in the range of 0.2 to 3.0 g per 1 $m^2$ of the support.

15. The image-receiving element for heat transfer type dye image according to claim 1, wherein the binder is at least one selected from the group consisting of hydrophilic polymers, hydrophobic polymers, a blend polymer using two or more of these polymers in combination, and a copolymer thereof with at least one of vinyl chloride and acrylate.

16. The image-receiving element for heat transfer type dye image according to claim 1, wherein the binder is hydrophilic polymers selected from the group consisting of gelatin, polyvinyl butyral, polyvinyl alcohol and ethylcellulose.

17. The image-receiving element for heat transfer type dye image according to claim 1, wherein the binder is heat-resistant hydrophobic polymers having a glass transition temperature of 40° to 250° C. selected from the group consisting of polystyrene, polyvinyl butyral, polyvinyl chloride, polyesters, polycarbonates and polyacrylates.

18. The image-receiving element for heat transfer type dye image according to claim 1, wherein the support is at least one selected from the group consisting of films of polyethylene terephthalate, polycarbonate, polystyrene, polyvinyl chloride, polyethylene and polypropylene and these films containing pigments, baryta paper, RC papers laminated with thermosetting resin containing pigments on a paper, clothes, glass, metals; supports coated with electron curable resin composition containing pigments to be cured on these, supports provided with a coating layer containing pigments on these and a cast coated paper.

* * * * *